United States Patent [19]

Brightman

[11] 4,090,048

[45] May 16, 1978

[54] DIFFERENTIAL PRESSURE ACTUATED SWITCH WITH CONTACT ON DIAPHRAGM

[76] Inventor: Alvin Brightman, 2449 Overlook Rd. #4, Cleveland Heights, Ohio 44106

[21] Appl. No.: 712,349

[22] Filed: Aug. 6, 1976

[51] Int. Cl.[2] ..... H01H 35/34

[52] U.S. Cl. ..... 200/83 N; 340/52 C; 200/83 Y; 200/81.4

[58] Field of Search ..... 340/52 C, 60, 69; 188/151 A; 303/6 A, 6 C; 200/302, 81.4, 81.5, 820, 83 A, 83 B, 83 Y, 83 N, 83 J, 83 W

[56] References Cited

U.S. PATENT DOCUMENTS

| | | | |
|---|---|---|---|
| 2,450,961 | 10/1948 | Heymann et al. | 200/83 A |
| 2,817,727 | 12/1957 | Schmeling | 200/83 B |
| 2,956,132 | 10/1960 | Hilgert | 200/83 N |
| 3,985,986 | 10/1976 | Doerfler | 200/83 Y |

*Primary Examiner*—Gerald P. Tolin

*Attorney, Agent, or Firm*—Oldham, Oldham, Hudak & Weber Co.

[57] ABSTRACT

A pressure actuated switch including a conductive frame forming a chamber having a pressure fluid inlet connecting thereto, a flexible diaphragm extending across the chamber to separate it into a first chamber connecting to the fluid inlet and a second chamber and where the flexible diaphragm mounts a contact means thereon which is movable into engagement with the second chamber wall when a suitable pressure differential exists between the chambers. A deformable member is positioned in the second chamber and is deformable by movement of the diaphragm towards the frame to bring the contact means into engagement with the frame so that the deformable member normally prevents contact closing action. Electrical connection means are present on the flexible diaphragm and extend from the contact means to a point remote from the frame, which connection means is insulated from the frame.

9 Claims, 4 Drawing Figures

FIG - 1
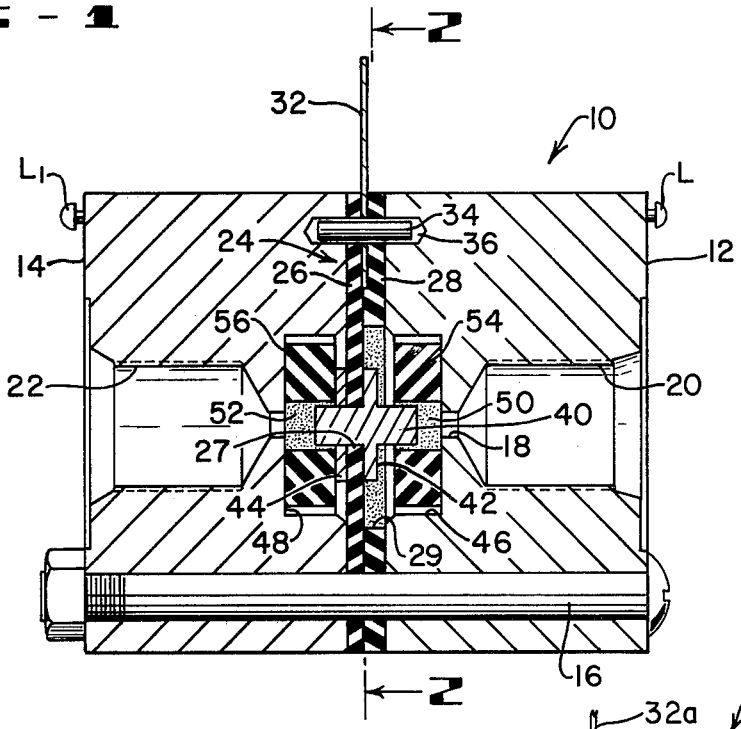
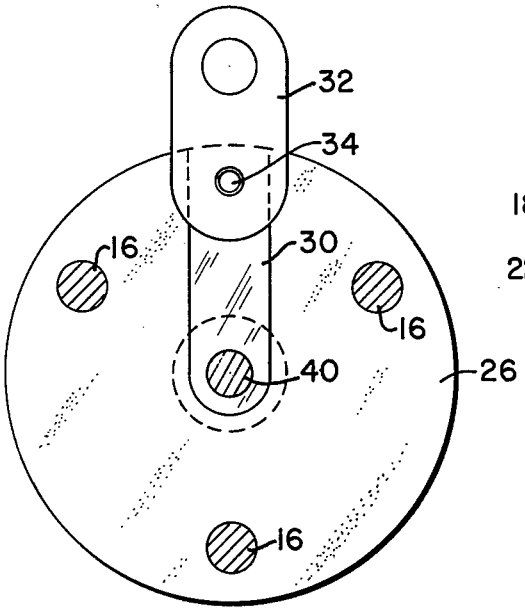
FIG - 2
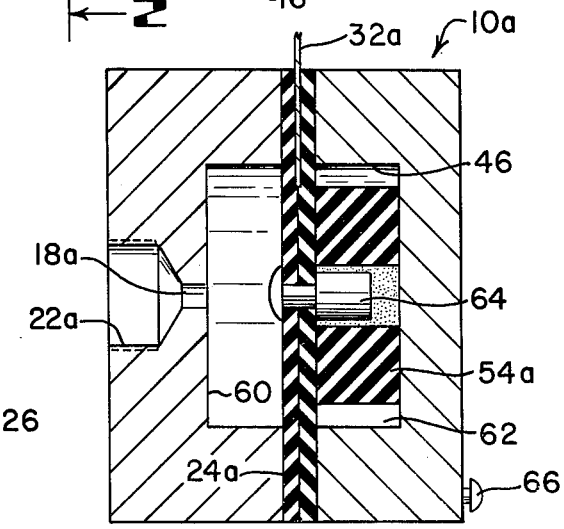
FIG - 3
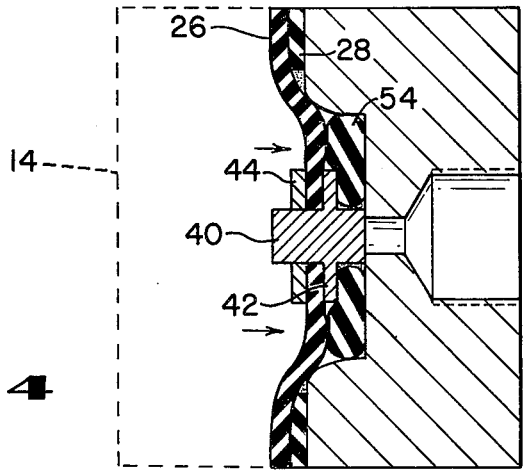
FIG - 4

DIFFERENTIAL PRESSURE ACTUATED SWITCH WITH CONTACT ON DIAPHRAGM

BACKGROUND OF THE INVENTION

Heretofore there have been many different pressure controlled switch constructions proposed, and many of such switches have been controlled by the differential in pressure applied to two different areas of the switch, or its controls. Normally two areas or chambers in the switch each have a fluid inlet connection provided therefor whereby the differential in the pressures applied on opposite faces of a flexible control diaphragm will control switch opening and closing action. Or, the two pressures can be applied to an axially movable member, such as a piston for switch closing and opening action, depending upon the switch design and the pressure differentials available. This general type of a control switch has been used in many instances in braking systems to indicate when braking pressures are equalized or when they become out of balance, and the differential pressure switches or pressure actuated switches have been used in many instances in pressure steering applications. Representative patents in the field include patents such as U.S. Pat. Nos. 3,807,809 and 3,737,603.

In some instances, a switch closing action has been provided by distortable diaphragms in the switches and patents on this type of switch include U.S. Pat. Nos. 2,817,727 and 3,534,328.

SCOPE OF THE PRESENT INVENTION

The present invention, as one embodiment thereof, relates to a pressure actuated switch including a conductive frame means forming an enclosed chamber having a pressure fluid inlet connecting thereto, a flexible diaphragm extending across the chamber to separate it into a first chamber connecting to the fluid inlet and into a second chamber, a member of flowable plastic positioned in and only partly filling the second chamber, which member is adjacent to the diaphragm and is deformed by movement of the diaphragm towards the frame to bring a contact means on the diaphragm into abutting engagement with the frame means. Such diaphragm movement is resisted in the second chamber and the member therein must be distorted by the diaphragm pressure and movement. A connection means operatively engages the contact means and extends from the frame in insulated relation thereto to form a terminal of the switch.

OBJECTS OF THE INVENTION

The present invention has as its general object the provision of a relatively inexpensive, positive acting switch controlled by pressure increases or pressure differentials applied to portions of the switch from one or more fluid containing systems connecting to the switch.

Another object of the invention is to provide a differential pressure actuated switch controlled by and connecting to two independent fluid pressure systems for contact opening and closing action depending upon the pressure differentials in the two systems or the absence thereof; and wherein a modification of the invention relates to a pressure actuated switch actuatable by variations in pressure differential between a fluid pressure system connected to a single chamber in the switch and such chamber and capable of moving a diaphragm forming a wall of the chamber when suitable pressure differentials exist.

Other objects of the invention are to provide pressure actuated switches having resilient, deformable, usually uncompressible members therein resisting movement of a control diaphragm in the switch by variation in the pressure applied thereto and wherein the characteristics of the switch can be controlled by variations in the physical characteristics of the elastic deformable member of members provided in the switch; to provide a flexible or resilient distortable diaphragm in a switch and which diaphragm is electrically conductive in one portion thereof or has a conductor associated therewith, but which diaphragm is insulated from a frame means in which it is positioned; and to provide a contact means extending in opposite directions from a center controlled diaphragm and which center contact means is set to close the switch upon a predetermined movement in either direction from a central neutral position.

The foregoing and other objects and advantages of the invention will be made apparent as the specification proceeds.

Reference now is made to the accompanying drawings, wherein:

FIG. 1 is a vertical longitudinal section of a switch embodying the principles of the invention;

FIG. 2 is a vertical cross section of the switch taken on line 2—2 of FIG. 1;

FIG. 3 is a vertical section through a modified switch of the invention; and FIG. 4 is a fragmentary section, like FIG. 1, but with the switch distorted to move into closed position.

When referring to corresponding members shown in the drawings and referred to in the specification, corresponding numerals are used to facilitate comparison therebetween.

Reference now is made to the details of the structure shown in the accompanying drawings, and a differential pressure actuated switch is indicated as a whole by the numeral 10. Such switch 10 comprises a frame means normally formed from two separate blocks or members 12 and 14 that are secured together by bolts 16, the blocks usually being made of metal. The frame means provides, in this instance, a central axially extending bore 18 which bore has a tapped enlarged end 20 and 22 for engaging with conduits, or equivalent means to secure the frame means to two different pressure systems. Other bores may be provided to connect the bores 18, 20 or 22, if desired.

A resilient, flexible, fluid pressure control diaphragm means or member 24 is operatively secured between the two adjacent faces of the metal blocks 12 and 14 to position a center control contact in the switch and to provide an electrical path from such center contact and a point external of the frame means. Thus, the diaphragm means 24 can be made in any conventional manner and in this particular structure shown, the diaphragm is made from a pair of resilient insulation sheets or discs 26 and 28 with the disc 26 having a relatively small aperture 27 therein whereas the flexible disc 28 may have a larger aperture 29 therein. FIG. 2 of the drawings best shows that the diaphragm or disc 26 has one radially extending area 30 thereof provided with a conductive portion or layer extending from the center of the disc out to the periphery thereof. Such conductive strip or layer may comprise a layer of a conductive paint, such as BEE black conductive coating No. R-61, or equivalent, or it may be a flexible lead or other suitable member. The conductive coating has a contact strip 32 in conductive contact therewith and extending from the frame body or means to provide a connection for one contact or terminal of the switch 10. Such contact strip 32 and the conductive coating 30 are retained in operative association with each other as by an alignment pin 34 extending through alignable holes provided in the contact strip and the two flexible discs 26 and 28. This alignment pin is received in suitable bores 36 provided in adjacent faces of the metal blocks 12 and 14. The alignment pin 34 is insulated from the metal frame means in any suitable manner as by making the pin from a non-conductive material. Also, it should be appreciated that the assembly of the flexible discs 26 and 28 has the conductive portion, strip or layer thereof insulated from the frame blocks or means, as by being sandwiched between the sheets or discs 26 and 28. A center contact member 40 is provided and it is secured to and positioned on the flexible disc 26. The contact 40 has ends protruding in opposed axial directions from the disc 26. The center contact pin also has an enlarged radial flange 42 thereon and the contact pin is held in engagement with its positioning diaphragm or disc by a metal washer 44 or the like that is in frictional or other engagement with one end portion of the contact pin and is pressed tightly against a surface of the flexible disc 26 so that such disc or diaphragm is compressed between adjacent flat face surfaces on the flange 42 and the washer 44.

Each of the blocks 12 and 14 on the flat faces thereof which are abutted to combine to form the frame or housing means for the switch have the center bore 18 of the switch counterbored or enlarged at adjacent abutted faces of the discs or blocks as at 46 and 48 so that such enlarged end bores are at the axial center of the switch. These counterbores form, in effect, a chamber 50 and a chamber 52 adjacent opposite faces of the diapgragm means, which chambers, usually annular, are made fluid tight when sources of pressure fluid are connected to the fluid inlets 20 and 22 or equivalents.

In order to aid in the control of pressure used for actuating the switch of the invention, a resilient deformable body 54 or 56, usually annular, is placed in the chamber 50 or 52, respectively, and which resilient bodies form with the center contact pin 40 and associated means a movable contact assembly in the switch 10. The drawing shows that the enlarged bores 46 and 48 are of larger diameters than the resilient bodies 54 and 56 received therein. The drawing also shows that the center contact pin 40 extends into center bores provided in the resilient bodies 54 and 56 to extend about one-half the axial depth thereof, or any other desired extent. On axial movement of the center contact pin 40 by deflection of the diaphragm means 24 because of differential fluid pressures on opposite faces of the diaphragm means, an end of the contact pin 40 can be moved into engagement with the surface of the block 14, or of the block 16 adjacent such end of the center contact pin. By clamping the center contact pin to the conductive coating or strip 30 on the diaphragm assembly, this forms an electrical contact with the center contact pin 40 for circuit closing action by the contact pin 40 engaging an end surface of the enlarged bore 46 or 48. A lead (not shown), connecting to a control circuit, is present at such end of the bore 46 or 48 if the blocks 12 and 14 are not metallic. The center contact pin 40 is of larger diameter than the diameter of the center bore 18 in the blocks 12 and 14. The flange 42 of the contact pin 40 and the diaphragm 24 deflect against the associated resilient bodies 54 and 56 which are distorted and caused to flow into empty areas in the bores 46 and 48. Sufficient axial movement of the contact pin is obtainable for circuit closing action when great enough pressure differential exists on the faces of the diaphragm means 24.

The flexible insulating diaphragm 24 can be made from any suitable elastomeric plastic or rubber material and one typical material is a plastic material known as Viton and which had a 70 durometer hardness when used in one embodiment of the invention. Likewise, the resilient bodies 54 and 56 may be made from the same material with the same durometer. However, the composition and durometer of the resilient bodies 54 and 56 can be varied and this will aid in controlling the amount of pressure differential required for sufficient axial movement of the center contact or pin to obtain circuit closing action.

A modified switch of the invention is indicated at **10*a* in FIG. 3. In this instance, a frame means similar to that shown in FIG. 1 is provided and it has a flexible diaphragm 24*a* secured to the frame means and extending transverse to a longitudinal axis thereof so as to form a first chamber 60 and an enclosed second chamber 62 in the frame means. This first chamber 60 connects by a bore 18*a* to a fluid pressure connection inlet or bore 22*a*** in the frame means.

A suitable electric contact 64 is secured in a known manner to the diaphragm means or assembly and it protrudes towards an end wall in the closed chamber 62. Connector means such as a wire or lead 66 connects to the frame means **10*a* and a companion lead can connect to a terminal 32*a* extending from the diaphragm means assembly. A resilient deformable member 54*a* is received in the closed chamber in the frame means and it substantially but not completely fills this chamber and abuts on the chamber end wall flat surface. However, a radially clear is open in the closed chamber so that when the pressure on the fluid supplied to the switch 10*a* of the invention through the fluid inlet 22*a* is sufficiently high, then the diaphragm means will be flexed and moved towards the end wall of the closed chamber against the resilient resistance of the member 54*a*. Such member 54*a*, like the members 54 and 56, must be distorted and caused to flow by the diaphragm 24*a*. The contact 64 is of shorter length than the resilient body 54*a* that flows but normally doesn't compress under pressure to let the contact 64** engage the metal end wall of the frame means and close a circuit. Such circuit can be used for any desired control function in the fluid circuits or associated means operatively connected to the control switch.

In use of the switch 10, it will be appreciated that any desired control circuit can be connected to the contact or lead 32 and to the housing member 12 or 14 as by leads L and L, so that a control action is obtained when a circuit is closed between the contact 40 and the frame means.

If the frame blocks 12 and 14 are insulated from each other, one control function is provided when a circuit with the center contact pin 40 is closed with the frame block 12, and a second, different control function is obtained when the center contact pin 40 moves into engagement with the metal frame block 14. The bolts 16 would be insulated from the blocks 12 and 14 in any suitable manner for such dual control function when the blocks are metal.

It also should be noted that the diaphragms 24 and 24a are supported over most of the area thereof to prevent blowout or fracture of the same. Hence, low cost flexible diaphragms can be used rather than more expensive metal diaphragms as used in most high pressure switches. The contacts 40 and 64 are loose in but substantially fill the center bores of the resilient support members 54, 56 or 54a. Sufficient open areas or volumes exist in the chambers 50, 52 and 62 that the resilient support or resistance members can be distorted and caused to flow by the pressures applied thereto by the diaphragms to permit the diaphragms to distort and move the contacts 40 or 64 to operative frame contact positions. Normally flat face surfaces are formed on the resilient members 54, etc. and such surfaces bear on the end wall of the chamber and receive the diaphragm pressure. Resilient flow or deformation of the member 54 must occur for the contact 40 to be moved to operative contact position by the flexible diaphragm 24. The corners or edges of the chambers 46 and 48 that engage the diaphragms are beveled or radiused to protect the diaphragms.

The switches of the invention are of quite sturdy construction and will operate on pressure differentials set up on opposite sides of the control diaphragms of the invention. The resilient bodies 54 and 56 usually are made from uncompressible plastic material. But the bodies 54 and 56 may be made of compressible material if suitable operating characteristics for the switch are obtained by use of that type of material in a switch construction of the invention. Usually the bodies 55, 56, etc. should be substantially confined in their positioning chambers and this aids in supporting the diaphragms 26, 28, etc. The switches will provide a long service life with minimum maintenance requirements. Thus, it is submitted that the objects of the invention have been achieved.

While two complete embodiments of the invention have been disclosed herein, it will be appreciated that modification of these particular embodiments of the invention may be resorted to without departing from the scope of the invention.

What is claimed is:

1. A pressure actuated switch comprising a frame means forming an enclosed chamber having a pressure fluid inlet connecting thereto, a flexible diaphragm supported at its periphery by said frame means and having a center area extending across said chamber to separate it into a first chamber connecting to said fluid inlet and a second chamber, a member of flowable plastic positioned in and only partly filling said second chamber, said member being adjacent to one face of said diaphragm and being deformed by movement of said diaphragm towards an end of said second chamber formed by said frame means, a contact means on said diaphragm and movable to operatively contact said frame means by deflection of said diaphragm against the deformation resistance of said member by pressure differential between said chambers, and connection means connecting to said contact means and extending from said frame to form a terminal of said switch.

2. A switch as in claim 1 where said plastic member is of a thickness to fill the second chamber in at least one portion thereof extending between said diaphragm and said end of said second chamber.

3. A pressure actuated switch as in claim 1 where said connection means are insulated from said frame means, and said member in said second chamber being annular and having radial clearance in said second chamber.

4. A pressure actuated switch as in claim 1 where a face of said diaphragm, said member and the end of the second chamber are normally in contact with each other, and said member supports substantially the entire center area of said diaphragm.

5. A pressure differential actuated switch comprising a frame having a pair of fluid inlets and a bore connecting the inlets, a flexible diaphragm on said frame and forming a seal extending across said center bore, a center contact on said diaphragm extending in opposed directions in said bore from said diaphragm, an electrical connector, insulated from said frame, communicating with said contact and extending to a point remote from said frame; said diaphragm being movable in either direction to move said contact to abut against said frame, and a flowable plastic member positioned adjacent each face of said diaphragm and resiliently resisting distortion of said diaphragm in either direction by any unbalanced pressures exerted thereon.

6. A switch as in claim 5 where said diaphragm forms two chambers in said bore, one plastic member being positioned in each of said chambers but only partly filling the same.

7. A switch as in claim 6 where said plastic members each have a face surface thereon adjacent said diaphragm, and said diaphragm is normally in operative contact with both of said face surfaces.

8. A switch as in claim 6 where said frame is metal and is formed in two parts, said diaphragm being positioned between said parts and insulating them from each other, said plastic member being made from substantially uncompressible material.

9. A pressure actuated switch comprising a frame means forming an enclosed chamber having a fluid inlet connecting thereto for connection to a fluid pressure system, a resilient elastomeric diaphragm extending across said chamber to separate it into a first chamber connecting to said fluid inlet and a second chamber, a spring member of resilient elastomeric material positioned in and only partly filling said second chamber, said member being adjacent to one face of said diaphragm and being of substantially the area of said diaphragm to support the same and being deformed by movement of said diaphragm towards an end of said chamber by pressure in said first chamber from the fluid pressure system, a contact means on said diaphragm and movable with the diaphragm to operatively engage said end of said second chamber of said frame means by deflection of said diaphragm against the deformation resistance of said member, a terminal for the switch associated with said second chamber end, and connection means connecting to said contact means and extending from said frame to form a second terminal of said switch.

* * * * *

UNITED STATES PATENT OFFICE

CERTIFICATE OF CORRECTION

Patent No. 4,090,048 Dated May 16, 1978

Inventor(s) Alvin Brightman

It is certified that error appears in the above-identified patent and that said Letters Patent are hereby corrected as shown below:

Column 3, line 37, change "diapgragm" to -- diaphragm --

Column 4, line 39, after "clear", insert -- area --

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*